US007044240B2

(12) United States Patent
McNeilly

(10) Patent No.: US 7,044,240 B2
(45) Date of Patent: May 16, 2006

(54) TORQUE ABSORBER FOR DOWNHOLE DRILL MOTOR

(76) Inventor: Keith McNeilly, 36 Parkway Cir., Houma, LA (US) 70364

( * ) Notice: Subject to any disclaimer, the term of this patent is extended or adjusted under 35 U.S.C. 154(b) by 211 days.

(21) Appl. No.: 10/739,538

(22) Filed: Dec. 18, 2003

(65) Prior Publication Data

US 2004/0129457 A1 Jul. 8, 2004

Related U.S. Application Data

(60) Provisional application No. 60/434,849, filed on Dec. 20, 2002.

(51) Int. Cl.
*E21B 17/07* (2006.01)

(52) U.S. Cl. ..... 175/57; 175/299; 175/305; 175/322; 175/323

(58) Field of Classification Search ..... None
See application file for complete search history.

(56) References Cited

U.S. PATENT DOCUMENTS 3,539,026 A 11/1970 Sutliff et al. ..... 175/299
4,518,888 A * 5/1985 Zabcik ..... 310/334
4,901,806 A * 2/1990 Forrest ..... 175/321

FOREIGN PATENT DOCUMENTS

NO 315209 7/2003

* cited by examiner

*Primary Examiner*—Zakiya W. Bates
(74) *Attorney, Agent, or Firm*—Bracewell & Giuliani LLP

(57) ABSTRACT

A torque absorber is disposed on a drill string near the motor. The torque absorber automatically adjusts the weight on a drill bit and reduces the likelihood of motor stall caused by resistance to drill bit rotation. The torque absorber includes an upper unit assembly and a lower unit assembly. The upper unit assembly includes a top sub and a ball body. The lower unit assembly includes a bottom sub, a lead screw, and a ball retainer. The components of the lower unit assembly are free to rotate as a result of motor back torque, which is in a direction opposite of the direction of rotation of the drill bit during normal drilling. The upper unit assembly will remain stationary while the components of the lower unit assembly rotate in this opposite direction. A spring applies a force on the lead screw.

17 Claims, 3 Drawing Sheets

TORQUE ABSORBER FOR DOWNHOLE DRILL MOTOR

This application claims benefit from U.S. Provisional Application No. 60/434,849, filed Dec. 20, 2002

BACKGROUND OF THE INVENTION

1. Field of the Invention

This invention relates to fluid driven downhole motors used in the oil and gas industry and, more particularly, to an apparatus for preventing stalling of such motors caused by excessive resistance during drilling or milling.

2. Description of the Related Art

A downhole motor may be utilized at some point during the drilling or producing life of an oil well to aid in the removal of solid materials from the well. The motor can be incorporated into a drill string to provide rotational torque to a drill bit or other similar downhole drilling or milling device without the need to rotate the entire drill string. The motor is attached near the bottom end of the drill string. The drilling device is attached at or near the bottom of the motor. The motor and drilling device are deployed into the well, and fluid is pumped through the drill string and into the body of the motor, driving the lower section of the motor and causing it to rotate. The drilling device rotates along with the lower section of the motor to engage and loosen materials within the well bore.

During the course of the drilling operation, the operator must maintain an optimum weight on the drilling device to facilitate drill penetration yet prevent motor stall. Motor stall can result from shifting and accumulation of debris near the drilling device, which can cause resistance to motor rotation and back torque by the motor. Motor stalling can cause increased pressure drop across the motor and diminish the life of the motor. A weight indicator reading at the surface can be used to monitor weight on the drilling device. Motor stall can be monitored by a pump pressure gauge. When stalled, a pump pressure reading in excess of the maximum recommended pump pressure at a given rate will be observed. Once a motor becomes stalled, the operator must hoist the work string to decrease weight on the drilling device until motor rotation resumes, then lower the work string to optimize weight on the bit. This process is time consuming and lengthens the drill phase.

Due to the limited torque output of downhole motors, stalling can be frequent. Also, maintaining optimal weight on the bit is difficult, as the operator must attempt to lower the work string at a rate concurrent with the removal of drilled off material. In addition, cuttings from the drilled material can shift and gather under the drill bit, increasing back torque or altering the weight on the bit and causing a stall. The objective in a drilling operation with a downhole motor is to penetrate as quickly as possible without stalling the motor.

SUMMARY OF THE INVENTION

In view of the foregoing, the torque absorber of the present invention advantageously provides an assembly for deployment in a well having a first module with a bore, a second module partially disposed within the bore of the first module, a helical interface between the first and second modules, so that rotation of one of the modules relative to the other causes the modules to telescopingly move relative to each other between contracted and extended positions, a spring member mounted between the first and second modules for urging the modules towards the extended position, and one of the modules adapted to be stationarily connected to a drill string and the other stationarily connected to a drill motor body to absorb countertorque on the drill motor body.

As further features, the assembly of the present invention may also include one or more of the following: a passage through the modules to transmit drilling fluid; a spring having at least one mechanical member that has a tendency to return to a natural state when deformed; a spring having a plurality of conical washers; a spring located in the bore of the first module; a helical interface including a helical groove on at least one of the modules; a helical interface including a helical groove on one of the modules and a plurality of roller elements rotatably mounted to the other module.

An alternative embodiment of the present invention advantageously provides a method of operating a rotary abrasive device mounted to an end of a conduit string. The method includes providing an assembly having a first module and a second module, the second module being partially disposed within a bore of the first module, the first and second module being helically movable relative to each other between retracted and extended positions and having a spring located between that urges them to the extended position, mounting the assembly in the string with one of the modules stationary with the string and the other stationary with a body of a motor for rotating the abrasive device, applying weight to the body of the motor by a downward force passing from the string through the modules and the spring, causing the motor to rotate the device, if the abrasive device begins to stall, allowing the motor body to rotate in an opposite direction, thereby causing one of the modules to rotate relative to the other and move toward the contracted position, further compressing the spring and reducing the weight on the motor body, and as the stall condition alleviates, causing spring to rotate the said one of the modules toward the extended position to again increase the weight on the bit. As a further feature, the method may include pumping a liquid down the string, through the assembly and to the motor.

BRIEF DESCRIPTION OF THE DRAWINGS

The various aspects of the invention will now be described by way of example only with reference to the accompanying drawings, in which.

DETAILED DESCRIPTION OF THE PREFERRED EMBODIMENT

Figures 1, 2, 3:
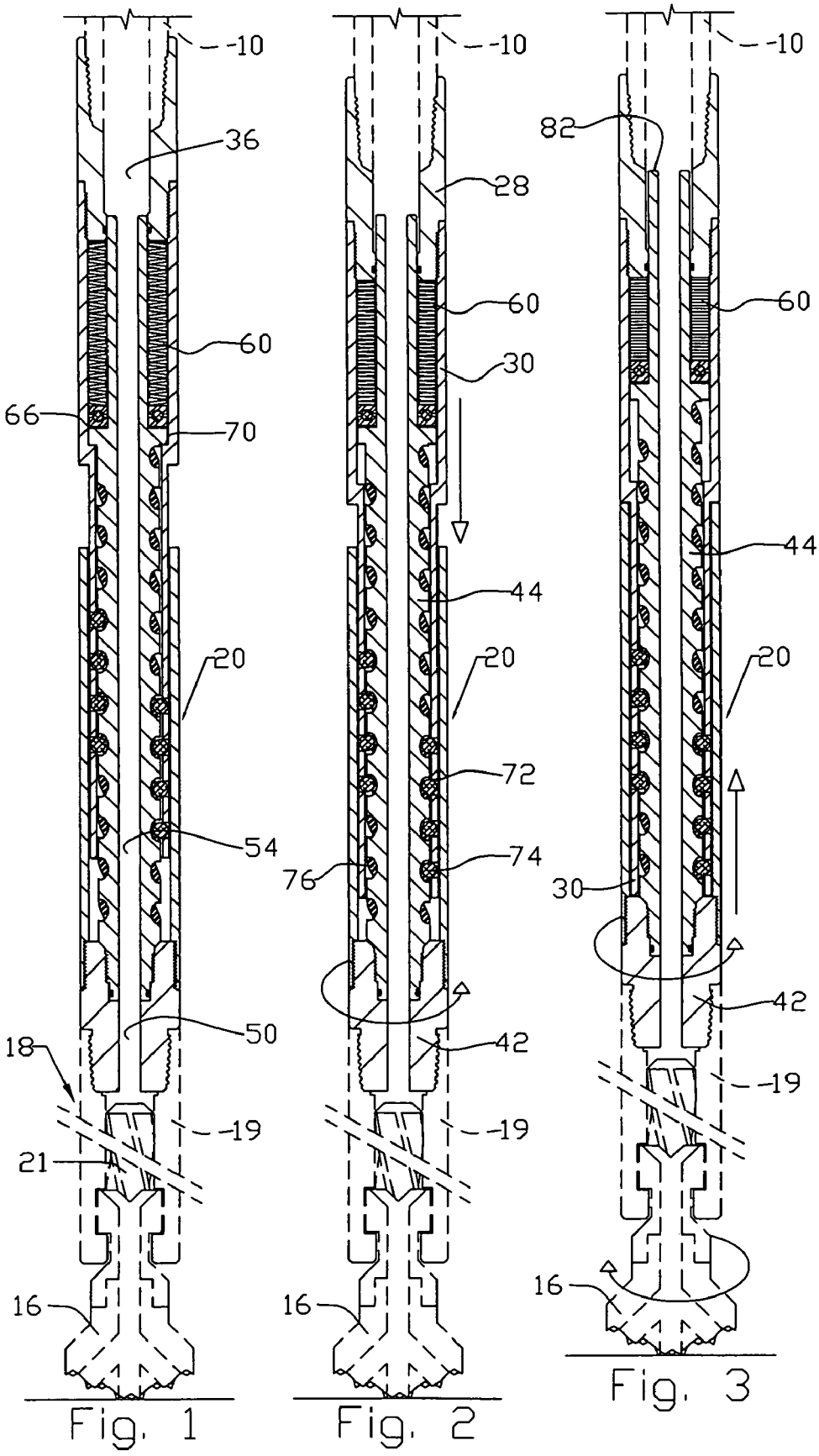
FIG. 1 is a side cross-section view of a torque absorber assembly in accordance with the invention in fully extended position.
FIG. 2 is a side cross-section view of the torque absorber of FIG. 1 in a partially contracted position due to applied weight.
FIG. 3 is a side cross-section view of the torque absorber of FIG. 1 in a fully contracted position due to back torque produced by the motor.

FIG. 1 shows the lower end of a drill string 10 which may be coiled tubing or sections of threaded drill pipe. At the lower end of the drill string 10 is a standard drill bit 16 or other drilling or milling tool. A conventional drilling-fluid powered motor 18 is disposed on the drill string 10 to rotate the bit 16 while drill string 10 is stationary. A torque absorber 20 according to the present invention is disposed on the drill string 10 near the motor 18. Motor 18 has an outer body 19 and an inner rotating shaft 21. Drilling fluid pumped down the interior of outer body 19 causes shaft 21 and drill bit 16 to rotate relative to outer body 19. The torque absorber 20 automatically adjusts the weight on the bit 16 and reduces the likelihood of motor stall caused by resistance to drill bit rotation.

Figure 4:
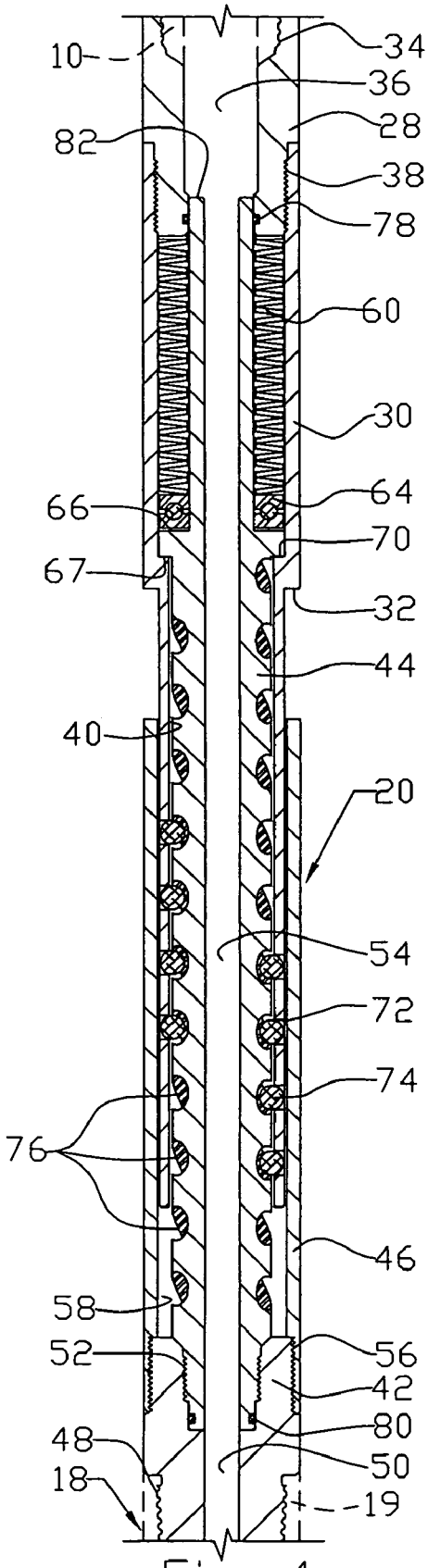
FIG. 4 is an enlarged side cross-section view of the torque absorber of FIG. 1.
Figure 5:
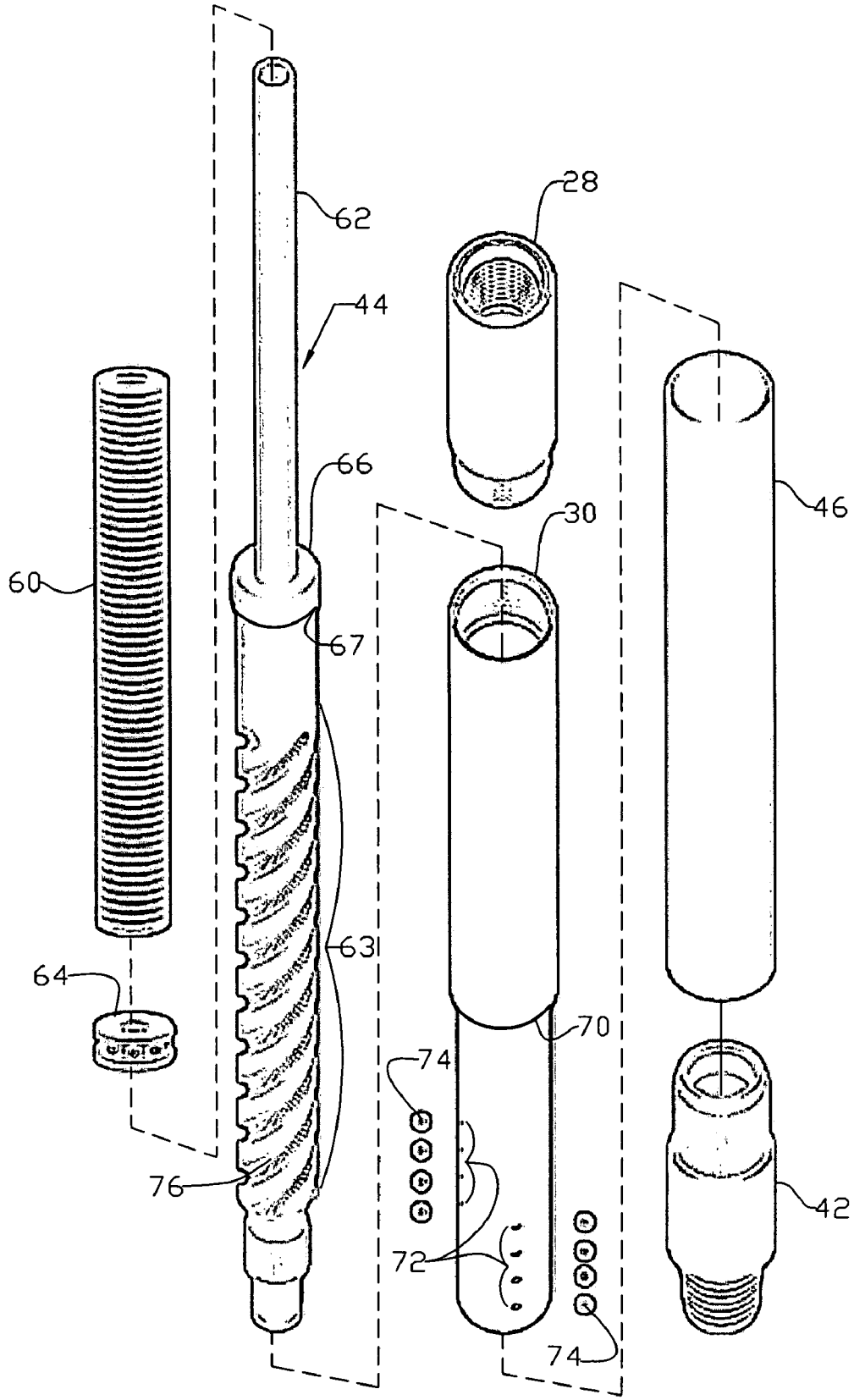
FIG. 5 is an exploded perspective view of the components of the torque absorber of FIG. 1.

Referring to FIGS. 4 & 5 also, the torque absorber 20 of the present invention includes a pair of modules, including an upper unit assembly 24 and a lower unit assembly 26. The upper unit assembly 24 includes a top sub 28 and a ball body 30 which comprises a cylindrical sleeve. In this embodiment, the top sub 28 is an adapter connected to an upper section of drill string 10 by threads 34 or some other suitable means. The top sub 28 has a conduit 36 therewithin for receiving fluid flow from the drill string 10. The top sub 28 is connected to the ball body 30 by threads 38 or some other suitable means. Ball body 30 has an external downward facing shoulder 32 and a cylindrical inner diameter 40.

Lower unit assembly 26 includes a bottom sub 42, a lead screw 44, and a ball retainer 46. In this embodiment, bottom sub 42 is an adapter connected to outer body 19 of motor 18 by threads 48 or some other suitable means. Bottom sub 42 has a conduit 50 therewithin for distributing fluid flow to motor 18. Bottom sub 42 is connected to an end of lead screw 44 by threads 52 or some other suitable means. Lead screw 44 has a conduit 54 therewithin for distributing fluid flow to the conduit 50 in bottom sub 42. Ball retainer 46 is connected to bottom sub 42 by threads 56 or some other suitable means. Ball retainer 46 generally surrounds the lead screw 44, defining an annular space 58 between the inner circumference of the ball retainer 46 and the outer circumference of the lead screw 44.

A spring 60, or other similar compression member with an annular hollow interior, is disposed to fit upon and surround a smaller diameter cylindrical upper portion 62 of lead screw 44. Preferably, spring 60 comprises a plurality of opposed conical disc spring washers such as Belleville springs. However, other types of spring 60 may be used that are known to those skilled in the art, for example, a gas or hydraulic spring. A thrust bearing 64 with an annular hollow interior is disposed to fit upon and surround the lower end of upper portion 62 of lead screw 44. Thrust bearing 64 sits upon an enlarged upward facing shoulder 66 located at the base of upper portion 62 of lead screw 44, and separates shoulder 66 from the lower end of spring 60 to reduce friction between the components. Shoulder 66 prevents thrust bearing 64 and spring 60 from moving to the bottom of lead screw 44.

Upper portion 62 of lead screw 44, thrust bearing 64 and spring 60 are disposed within the hollow annular interior of ball body 30. A downward facing shoulder 67 located adjacent to the upper end of an enlarged lower portion 63 of lead screw 44 sits upon an upward facing shoulder 70 on an interior wall of ball body 30 when torque absorber 20 is fully extended as shown in FIGS. 1 & 4.

In a preferred embodiment, ball body 30 has a plurality of holes 72 drilled or otherwise formed into its wall that correspond to the locations of an external helical groove 76 formed on the lower portion 63 of lead screw 44. A plurality of lead screw balls or other roller elements 74 are positioned within some or all of holes 72 in ball body 30. Screw balls 74 protrude and rotationally engage helical groove 76 of lead screw 44. Helical groove 76 and balls 74 act as mating low friction threads, so that rotation of lead screw 44 relative to ball body 30 causes lead screw 44 to move upward or downward relative to ball body 30. Ball body 30 and screw balls 74 are at least partially disposed within the annular space between ball retainer 46 and lead screw 44. Ball retainer 46 prevents balls 74 from falling laterally out of holes 72 in ball body 30. Although the use of balls 74 is a preferred embodiment, balls 74 may be replaced by any type or number of devices, whether fixed or detached, without departing from the spirit or scope of the present invention. As illustrated by the section lines, the components of the helical interface including ball body 30 and lead screw 44 are formed of metal. Preferably, top sub 28 is attached to the top of ball body 30, and bottom sub 42 is attached to the bottom of ball retainer 46.

Conduits 36, 54 & 50 in top sub 28, lead screw 44, and bottom sub 42, together form a central bore in torque absorber 20 for fluid to pass from upper drill string 32, through the assembled torque absorber 20, and to motor 18. A seal 78 between top sub 28 and upper section 62 of lead screw 44 provides pressure integrity. A seal 80 between lower section 63 of lead screw 44 and bottom sub 42 provides pressure integrity. As illustrated, there are no reduced diameter sections having larger diameter sections above and below either in bore 36 or in flow passage 54. Top sub 28 is attached to an upper section of drill string 32, and the upper unit assembly 24 is held stationary by drill string 32. Bottom sub 42 is attached to outer body 19 of motor 18, and the components of lower unit assembly 26, i.e., bottom sub 42, lead screw 44 and ball retainer 46, are free to rotate as a result of motor back torque imposed on motor outer body 19, which is in a direction opposite of the direction of rotation of drill bit 16 during normal drilling. Upper unit assembly 24 will remain stationary while the components of lower unit assembly 26 rotate in this opposite direction.

FIGS. 1, 2 and 3 show a preferred embodiment of torque absorber 20 during various stages of operation. FIG. 1 specifically shows torque absorber 20 prior to imposing weight on drill string 10. Spring 60 is in fully extended position, and there is no rotational movement of lower unit assembly 26 relative to upper unit assembly 24. Lead screw shoulder 66 is in contact with upper body shoulder 70. Drilling fluid flowing through conduits 36, 54 & 50 causes drill bit 16 to rotate relative to motor body 19.

FIG. 2 shows a partially contracted position. This position could occur due to weight being applied in a downward direction to drill string 10 by the operator. In response to the weight, top sub 28 and ball body 30 move downward relative to lead screw 44. The downward movement of ball body 30 causes lead screw 44 and lower sub 42 to rotate in a reverse direction to bit 16. Because lead screw 44 does not move downward, the lower end of top sub 28 compresses spring 60. A downward force passes from drill string 10 through top sub 28, spring 60, lead screw 44 and motor body 19 to bit 16. As top sub 28 advances downward, screw balls 74 in holes 72 in ball body 30 move within helical groves 76 in lead screw 44 to cause the rotational movement of lead screw 44. Reducing weight on drill string 10 caused top 28 to move upward and screw 44 to rotate the opposite direction to relieve weight on bit 16. The compressed spring 60 maintains enough appreciable weight on bit 16 to accomplish rotation and drilling in well bore 14. The piston effect on the upper end of lead screw 44 also applies a downward force on lead screw 44 due to fluid pressure. Spring 60 transmits from drill string 10 all of the weight desired on drill bit 16.

FIG. 2 is a normal drilling position. If bit 16 encounters resistance against rotation, the countertorque on motor body 19 increases. This countertorque causes lead screw 44 to rotate in a counterclockwise direction and advance upwards relative to top sub 28. The upward movement of lead screw 44 lifts bit 16 upward slightly as can be seen in FIG. 3. This upward movement on bit 16 reduces the weight on bit 16, causing the counter torque on motor body 19 to reduce. The upward movement of lead screw 44 also further compresses spring 60. Spring 60 applies a greater force on lead screw 44, causing it to rotate back downward to the position of FIG. 2 once the countertorque on motor body 19 reduces. The operator continues applying the same weight during the upward and downward movement of lead screw 44.

The maximum distance of lead screw 44 advancement upward is equivalent to the fully extended distance between the lower end of ball body 30 and the upper end of bottom sub 42. As illustrated in FIG. 3, once the lower end of ball body 30 has contacted the upper end of bottom sub 42, advancement of lead screw 44 is stopped. At this point, spring 60 is fully compressed. Upward lead screw 44 advancement is resisted by spring 60 and also by a piston area 82 formed by the upper end of lead screw 44. The maximum distance of advancement of the lead screw 44 and the spring rate together determine the maximum amount of torque stored in the spring 60 when fully compressed.

An overall lengthening or shortening of torque absorber 20 can alter the distance of telescoping travel for lead screw 44. Varying the stack length, washer thickness, and stack configuration of spring 60 can produce different spring rates. The downward force of spring 60 is assisted by internal pressure exerted upon the effective piston area 82 imposed by drilling fluid pressure. Changing the effective piston area 82 can change the force applied, and thus an optimal force at a given pump rate, torque and applied weight can be achieved. Preferably, when fully collapsed by applied weight, torque absorber 20 should store the same amount of torque via lead screw 44 advancement as that of motor 18 at maximum torque output. Downhole motor 18 may vary in maximum torque, maximum weight on bit, optimal gallons per minute, and optimal pressure drop.

The present invention has a number of advantages. For example, the invention provides an operator with greater control over a downhole motor and bit and enhances the working life of a motor. In addition, when used without a motor, the torque absorber will automatically rotate with the drill string when weight is applied and the unit is in the full contracted position. In addition to drilling and milling, it can be used for tool orientation and other applications.

While the invention has been described herein with respect to a preferred embodiment, it should be understood by those that are skilled in the art that it is not so limited. The invention is susceptible of various modifications and changes without departing from the scope of the claims. For example, the torque absorber could be inverted so that the ball body is rigidly connected to the motor body and the lead screw rigidly connected to the drill string. Telescoping and rotational movement between the lead screw and the motor body would still occur as a result of back torque on the motor body. Further, the helical groove could optionally be located on the inner diameter of the ball body rather than the exterior of the lead screw.

I claim:

1. An assembly for deployment in a well bore, comprising:

a drill string;

a downhole drill motor carried at a lower end of the drill string;

a rotary abrasive device coupled to the drill motor for rotation relative to the drill string in response to drilling fluid being pumped down the drill string;

a tubular first module;

a tubular second module partially disposed within the the first module;

one of the modules being connected to the drill string and the other of the modules being connected to the drill motor;

a passage through the modules to transmit drilling fluid to the drill motor;

a helical interface between the first and second modules, so that rotation of one of the modules relative to the other due to changes in counter torque on the drill motor causes the modules to teleseopingly move relative to each other between contracted and extended positions; and a spring member mounted between the first and second modules for urging the modules towards the extended position.

2. The assembly of claim 1, wherein the helical interface causes the modules to move toward the contracted position when the module connected to the drill motor rotates relative to the other module in an opposite direction to the rotation of the abrasive device.

3. The assembly of claim 1, wherein the portion of the passage through the module connected to the drill motor is free of any reduced diameter sections located between upstream and downstream sections of greater diameters.

4. The assembly of claim 1, wherein the spring comprises a plurality of separate spring members stacked axially on each other, relative to an axis of the modules.

5. The assembly of claim 1, wherein the spring has sufficient capacity to transmit from the first module to the second module and drill motor the entire weight on the drill string applied to the first module.

6. The assembly of claim 1, wherein the portions of the first and second modules containing the helical interface are both formed of metal.

7. A method of operating a rotary abrasive device mounted to an end of a conduit string comprising:

(a) providing an assembly having a first module and a second module, the second module being partially disposed within a bore of the first module, the first and second module being helically movable relative to each other between retracted and extended positions and having a spring located between that urges them to the extended position;

(b) mounting the assembly in the string with one of the modules stationary with the string and the other stationary with a body of a motor for rotating the abrasive device;

(c) applying weight to the body of the motor by a downward force passing from the string through the modules and the spring;

(d) causing the motor to rotate the device;

(e) if the abrasive device begins to stall, allowing the motor body to rotate in an opposite direction, thereby causing one of the modules to rotate relative to the other and move toward the contracted position, further compressing the spring and reducing the weight on the motor body; and (f) as the stall condition alleviates, causing spring to rotate the said one of the modules toward the extended position to again increase the weight on the abrasive device.

8. The method of claim 7, wherein step (d) further comprises pumping a liquid down the string, through the assembly and to the motor.

9. The method of claim 7, wherein substantially all of the weight applied to the body of the motor in step (c) comes from the weight of the string.

10. An assembly for drilling a well with a downhole drill motor, comprising:

first and second tubular modules, one partially inserted into the other, the first module adapted to be connected to a drill string and the second module adapted to be connected to a drill motor housing of a drill motor;

a flow passage extending through the modules for delivering drilling fluid to the drill motor to rotate a drill bit in a first direction relative to the drill motor housing, the first and second modules and the drill string;

a helical interface between the modules, so that rotation of the second module in a second direction relative to the first module due to counter torque from the drill motor housing causes the modules to telescopingly move relative to each other toward a contracted position; and a spring member mounted between the first and second modules for urging the modules towards a extended position.

11. The assembly of claim 10, wherein the flow passage through the modules is free of any reduced diameter sections located between upstream and downstream sections of greater diameters.

12. The assembly of claim 10, wherein the spring comprises a plurality of separate spring members stacked axially on each other, relative to an axis of the modules.

13. The assembly of claim 10, wherein the spring has the capacity to transmit sufficient weight of the drill string to the second module and drill motor to achieve a desired weight on the drill bit.

14. The assembly of claim 10, wherein the portions of the first and second modules containing the helical interface are both formed of metal.

15. An assembly for drilling a well with a downhole drill motor, comprising:

first and second tubular modules, one partially inserted into the other, the first module adapted to be connected to a drill string and the second module adapted to be connected to a drill motor housing of a drill motor;

a flow passage extending through the modules for delivering drilling fluid to the drill motor to rotate a drill bit clockwise, when viewed above, relative to the drill motor housing, the first and second modules and the drill string;

a clockwise helical interface between the modules, so that rotation of the second module counterclockwise relative to the first module due to counter torque from the drill motor housing causes the modules to telescopingly move relative to each other toward a contracted position; and a plurality of spring members mounted between the first and second modules and stacked axially upon each other, relative to an axis of the modules, for transmitting weight from the drill string to the drill bit.

16. The assembly of claim 15, wherein the spring members having the capacity to transmit to the second module from the weight of the drill string all downward force desired upon the drill bit.

17. The assembly of claim 15, wherein the flow passage through the modules is free of any reduced diameter sections located between upstream and downstream sections of greater diameters.

* * * * *